United States Patent [19]

Bruno

[11] 4,018,385

[45] Apr. 19, 1977

[54] OSCILLATING SPRAY HEAD

[76] Inventor: Leonard Bruno, 87 Lambert Ave., Farmingdale, N.Y. 11735

[22] Filed: Nov. 6, 1975

[21] Appl. No.: 629,487

[52] U.S. Cl. ..... 239/102; 239/381; 239/548

[51] Int. Cl.[2] ..... B05B 1/34

[58] Field of Search ..... 239/102, 383, 381, 389, 239/101, 548

[56] References Cited

UNITED STATES PATENTS

| | | | |
|---|---|---|---|
| 881,842 | 3/1908 | Bender | 239/381 X |
| 3,734,410 | 5/1973 | Bruno | 239/381 X |
| 3,929,287 | 12/1975 | Givler et al. | 239/389 X |

*Primary Examiner*—Evon C. Blunk
*Assistant Examiner*—Michael Mar
*Attorney, Agent, or Firm*—Jacob L. Kollin

[57] ABSTRACT

An oscillating spray head attachable to a source of fluid. The head comprises a housing having an inlet and outlet. A cover having apertures is secured to the outlet. An oscillating plate, provided with hollow posts extending therethrough and into the apertures in the cover, is positioned in the housing between the cover and the inlet. The plate oscillates on two bars formed on the inner face of the cover, and spaced from one another.

7 Claims, 4 Drawing Figures

OSCILLATING SPRAY HEAD

BACKGROUND OF THE INVENTION

Figure 1:
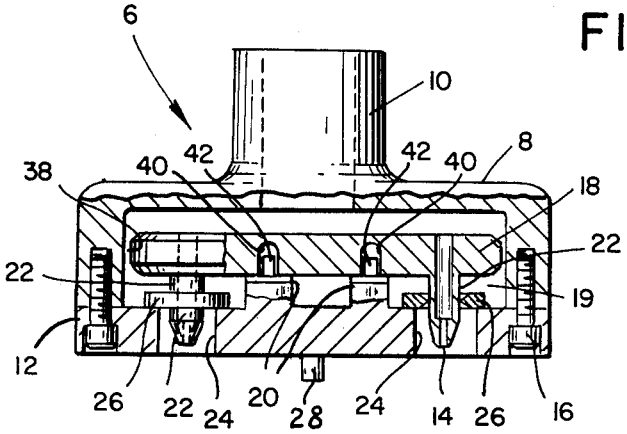

The invention relates to spray devices in general and in particular to an oscillating spray head for a shower and the like.

An object of the invention is to provide a spray head which will emit an oscillating spray.

Another object of the invention is to provide a spray head of the above character having a housing and an oscillating plate therein for emiting such a spray.

A further object of the invention is to provide a device of the above character wherein the oscillating plate has hollow posts integral therewith and extending into apertures in the housing.

Still another object of the invention is to provide such a device having a reset pin for resetting the oscillating plate on failure to operate.

Yet another object of the invention is to provide a spray head which is simple in construction, dependable in operation and economical to manufacture.

These and other objects of the invention will become apparent from the following description in connection with the appended drawing illustrating a preferred embodiment of the invention. It is to be understood, however, that these are given by way of illustration and not of limitation and that changes may be made in the detail construction, form and size of the parts, without affecting the scope of the invention sought to be protected.

Figure 3:
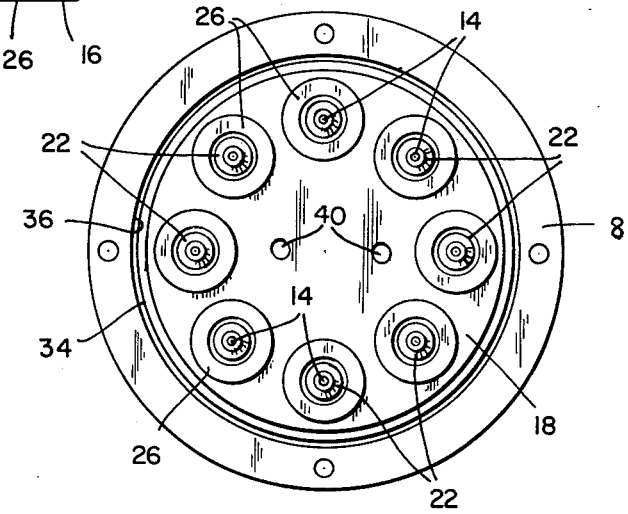
Figure 2:
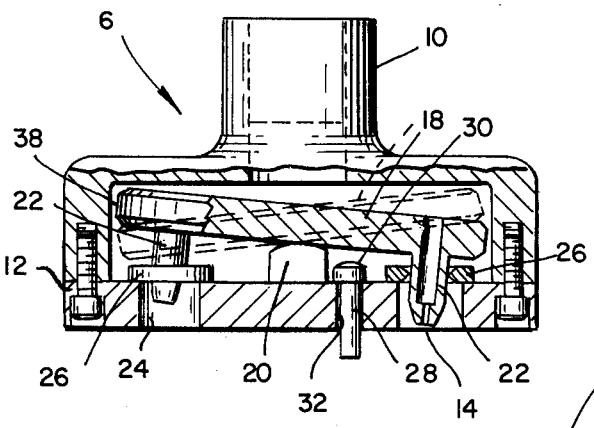
Figure 4:
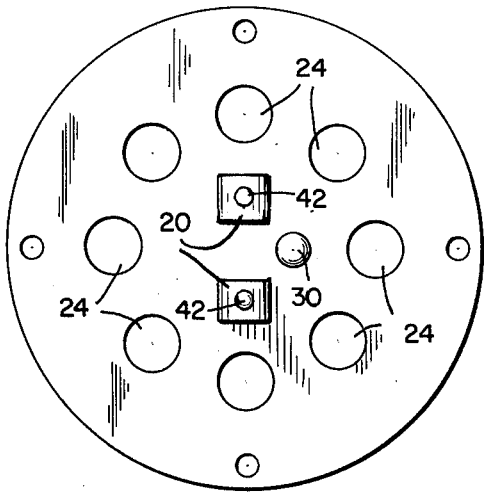

In the drawings:

FIG. 1 is an elevational cross-section of the oscillating spray head in non-operative rest position, FIG. 2 is a view similar to FIG. 1, with the spray head in operating condition, shown at a right angle to FIG. 1, FIG. 3 is a view from the bottom of the spray head housing with the cover removed, and FIG. 4 is a top view of the inside face of the housing cover.

Referring now to the drawing in detail, the spray head, generally indicated as 6, comprises an annular housing 8 having an inlet 10 and a cover 12, secured to the outlet 14 by screws 16. An annular plate 18 conforming to the inner shape of the housing is positioned for oscillation on spaced bars 20 extending midway of the cover 12, the bars being integral with the cover.

The plate is provided with circumferentially positioned hollow posts 22 spaced inwardly of the plate's edge and extending into apertures 24 located in cover 12 and aligned with said posts. The apertures are large enough to permit the posts to move laterally therein. Superimposed on the inner face of the cover 12 are seals 26 of resilient material, such as rubber or the like, with the hollow posts 22 extending therethrough. The cover 12 and annular plate 18 form a chamber therebetween.

There is provided in the cover plate a reset pin or button 28 formed with a head 30. The pin extends through an aperture 32 in the cover plate and is used to push the plate 18 up when it fails to oscillate. The pin is held down by the pressure of water in the chamber.

In the embodiment described, the peripheral edge 34 of plate 18 is spaced from the inner wall 36.008 inches, forming an annular space 38 to permit the oscillation of the plate. Further, as indicatd in FIG. 1, the width of the plate 18 between the upper face of the plate and the lower face of the plate 18 determines the amplitude of oscillations of the plate. Also, the inner diameter of the seals 26 is 0.005/0.008 larger than the outside diameter of hollow posts 22 to permit the plate 18 to oscillate. Although the above dimensions have been found appropriate for the operation of the embodiment, they are not limiting. To prevent lateral displacement of the plate 18, it is provided with recesses 40 which receive guide pins 42, integral with the bars 20.

In use, the spray head functions as follows:

Water entering the spray head through inlet 10 strikes the plate 18 and starts the oscillation of the plate to either side of the two bars 20, 20. As soon as chamber 19 is full, pressure is equalized and oscillation is uniform. At the same time the stream of water is forced through the hollow posts 22. Due to their larger internal diameter, the seals 26 permit these posts to freely move in the apertures 24. The seals are constantly in contact with the cover plate due to the water pressure. The seals will, however, move laterally. A negligible amount of water will pass through the annular space without affecting the operation of the spray head.

I claim:

1. An oscillating spray head for securing to a source of fluid under pressure comprising a spray housing provided with an inlet and outlet and an inner wall, a cover secured to said outlet, said cover having a plurality of apertures therethrough disposed spacedly of said outlet and an outer edge portion, said cover having an inner face formed with spaced bars extending midway thereof, an oscillating plate superimposed on said spaced bars, and means in said plate cooperating with said apertures for forming an oscillating spray of fluid comprising a plurality of circumferentially disposed hollow posts integral with said plate, said posts extending through said plate into said apertures and being aligned therewith.

2. The spray head as claimed in claim 1, wherein the outside diameter of said hollow posts is smaller than the diameter of said apertures.

3. The spray head as claimed in claim 1, further provided with a plurality of ring-shaped seals of resilient material superimposed on the inner face of said cover over said apertures, respectively, said seals being laterally displaceable on said inner face of said cover.

4. The spray head as claimed in claim 3, further provided with reset means for restoring an oscillation of said plate in case of failure to oscillate.

5. The spray head as claimed in claim 4, wherein said means for restoring oscillation is a pin displaceable through a hole formed in said cover, said pin being formed with a head element, for retaining said pin in said housing.

6. The spray head as claimed in claim 5, wherein said ring-shaped seals are of larger inner diameter than the outside diameter of said posts.

7. The spray head of claim 6 wherein said plate has recesses for receiving guide pins extending from said bars.

* * * * *